US006416205B2

(12) United States Patent
Uedono

(10) Patent No.: US 6,416,205 B2
(45) Date of Patent: Jul. 9, 2002

(54) LAMP PROTECTING DEVICE

(75) Inventor: Yoshikazu Uedono, Kiryu (JP)

(73) Assignee: Japan Servo Co., Ltd., Tokyo (JP)

( * ) Notice: Subject to any disclaimer, the term of this patent is extended or adjusted under 35 U.S.C. 154(b) by 0 days.

(21) Appl. No.: 09/960,323

(22) Filed: Sep. 24, 2001

Related U.S. Application Data

(62) Division of application No. 09/532,954, filed on Mar. 22, 2000.

(30) Foreign Application Priority Data

Mar. 24, 1999 (JP) ..... 11-079220
Mar. 24, 1999 (JP) ..... 11-079221

(51) Int. Cl.[7] ..... F21V 15/00

(52) U.S. Cl. ..... 362/376; 362/365; 362/292; 362/354

(58) Field of Search ..... 362/376, 364, 362/365, 291, 292, 354

(56) References Cited

U.S. PATENT DOCUMENTS 4,510,559 A * 4/1985 Kristofekl ..... 362/269
5,800,052 A * 9/1998 Yeh ..... 362/376

* cited by examiner

*Primary Examiner*—Alan Cariaso
*Assistant Examiner*—Anabel Ton
(74) *Attorney, Agent, or Firm*—Birch, Stewart, Kolash & Birch, LLP

(57) ABSTRACT

A lighting fixture mounting device comprises a U shape channel having a bottom plate, side walls, extruding portions extruding sideward from both sides of the bottom plate and a wiring hole bored through the bottom plate. The lighting fixture is attached to the extruding portions, a wiring of the lighting fixture passes through the wiring hole and inside of the U shape channel to be connected to an external electric source, and the side walls are fixed to an object to which the lighting fixture is to be fixed. A lamp protecting device for a lighting fixture embedded in a built-in hole formed in a ceiling and having a flange formed on a lower end of a case of the lighting fixture and exposed out of the ceiling, comprises a guard fixing attachment made of a rectangular plate having a cutout through which the case can be passed through and outer ends folded to form steps corresponding to the thickness of the flange, and a guard made of circular members and rod like members connecting the circular members. The lighting fixture is moved downward to make a gap between lower surface of the ceiling and upper surface of the flange, the guard fixing attachment is inserted into the gap, the lighting fixture is moved upward to fix the guard fixing attachment in between the lower surface of the ceiling and the upper surface of the flange, and the guard is attached to the guard fixing attachment.

12 Claims, 4 Drawing Sheets

LAMP PROTECTING DEVICE

This application is a divisional of co-pending application Ser. No. 09/532,954, filed on Mar. 22, 2000, the entire contents of which are hereby incorporated by reference and for which priority is claimed under 35 U.S.C. §120; and this application claims priority of Application No. 11-079220 filed in Japan on Mar. 24, 1999 and Application No. 11-079221 filed in Japan on Mar. 24, 1999 under 35 U.S.C. §119.

BACKGROUND OF THE INVENTION

1. Field of the Invention

The present invention concerns a lighting fixture mounting device and a lamp protecting device, particularly a lighting fixture mounting device by which wiring can be dealt with easily when the mounting device is fixed to a pillar or a wall, and a lamp protecting device for protecting a lamp or lamps in a lighting fixture installed in a ceiling.

2. Description of the Prior Art

In general, a wiring for a lighting fixture is laid inside of a pillar or a wall in advance of installing the lighting fixture. When the lighting fixture is mounted, the wiring is used to electrically connect the lighting fixture with an external electric sauce. However, in case that a pillar or a wall is too thin to include wiring within it, the wiring is fixed on the surface of the pillar with binding bands or spiral tubes, or on the surface of the wall with fixing parts such as clamps.

In case that the wiring is fixed on a surface of a pillar or a wall, the appearance is spoiled and there is a possibility that the electric wires and/or the lighting fixture may be damaged by a mechanical interference. Accordingly, a lighting fixture mounting device that can be easily connected with wiring without exposing the wiring outside is desired.

Likewise, it sometimes is the case that a guard for protecting a lamp or lamps from an interference from the outside becomes necessary. If the necessity of the guard was known at the time of installation of a lighting fixture, then a lighting fixture to which a lamp protecting device could be attached, or a lighting fixture with a lamp protecting device, might have been chosen to be installed. However, in case that the necessity of the guard was not known beforehand, a lamp protecting device is attached later on to the lighting fixture at the time when the guard becomes necessary.

In this case, the installed lighting fixture is exchanged with a newly chosen lighting fixture with a lamp protecting device, or with a lighting fixture to which a guard for lamp can be attached. Or, the installed lighting fixture may be removed, a lamp protecting device is attached to it, then the lighting fixture with the lamp protecting device is installed again.

When the installed lighting fixture is exchanged with a lighting fixture with a lamp protecting device, costs for purchasing a new lighting fixture as well as costs for removing the installed lighting fixture and installing the new lighting fixture are required.

Moreover, in case that a lamp protecting device is attached to an existing lighting fixture installed in a ceiling, wiring must be disconnected from the lighting fixture when it is removed from the ceiling, a guard is attached to the lighting fixture, then the lighting fixture is installed again into the ceiling and the wiring is connected to the lighting fixture again. Accordingly, an additional wiring work inside of the ceiling is required, for which additional time and costs are required.

SUMMARY OF THE INVENTION

It is an object of the present invention to provide a lighting fixture mounting device that can be easily connected with wiring without exposing the wiring outside. Further, it is another object of the present invention to provide a lamp protecting device that can be attached to an installed lighting fixture without disconnecting wiring.

According to the present invention, there is provided a lighting fixture mounting device comprising a U shape channel having a bottom plate, side walls, extruding portions extruding sideward from both sides of the bottom plate, and at least one wiring hole bored through the bottom plate. The lighting fixture is attached to the extruding portions, a wiring of the lighting fixture passes through the wiring hole and inside of the U shape channel to be connected to an external electric source, and the side walls are fixed to an object to which the lighting fixture is to be fixed.

Further according to the present invention, there is provided a lamp protecting device for a lighting fixture embedded in a built-in hole formed in a ceiling and having a flange formed on a lower end of a case of the lighting fixture and exposed out of the ceiling. The lamp protecting device comprises a guard fixing attachment made of a rectangular plate having a cutout through which the case can be passed through and outer ends folded to form steps corresponding to the thickness of the flange, and a guard made of a plurality of circular members and rod like members connecting the circular members. The lighting fixture is moved downward to make a gap between lower surface of the ceiling and upper surface of the flange, then the guard fixing attachment is inserted into the gap, then the lighting fixture is moved upward to fix the guard fixing attachment in between the lower surface of the ceiling and the upper surface of the flange, and then the guard is attached to the guard fixing attachment.

BRIEF DESCRIPTION OF THE DRAWINGS

FIG. 1(*d*) is a sectional view of a U shape channel used in the second embodiment of the lighting fixture mounting device according to the present invention in which the lighting fixture is fixed on a flat surface such as a surface of a wall or a ceiling.

FIG. 1(*e*) is another sectional view of a U shape channel used in the third embodiment of a lighting fixture mounting device according to the present invention in which the lighting fixture is fixed on a flat surface such as a surface of a wall or a ceiling.

DETAILED DESCRIPTION OF THE INVENTION

Figure 1A:
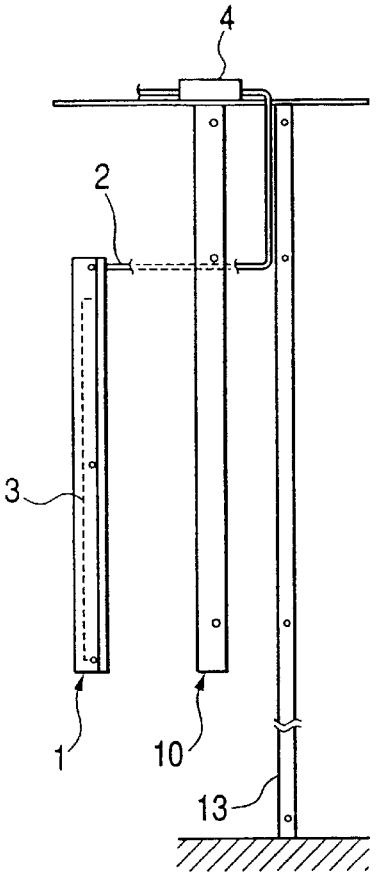
FIGS. 1(*a*) to 1(*c*) are drawings showing the first embodiment of the lighting fixture mounting device according to the present invention, in which FIG. 1(*a*) is an exploded side view of a lighting fixture mounting device, FIG. 1(*b*) is a side view of the lighting fixture mounting device fixed on a surface of a pillar and FIG. 1(*c*) is a sectional view taken along line A—A FIG. 1(*b*).
Figure 1B:
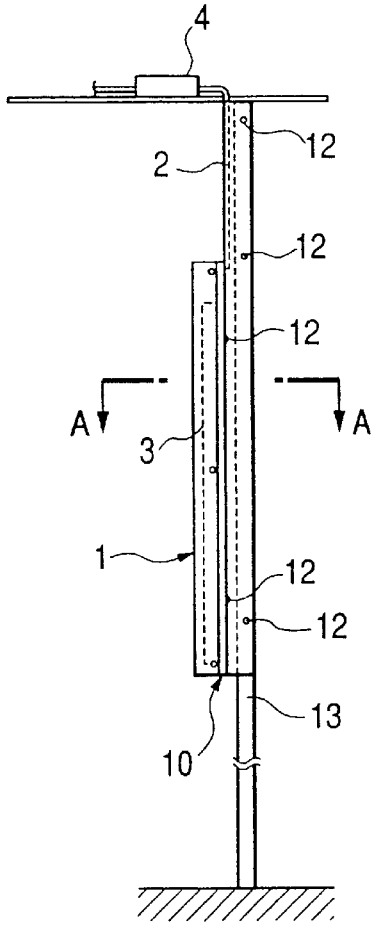
Figure 1C:
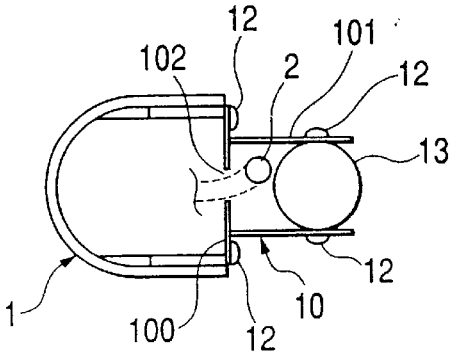
Figure 1D:
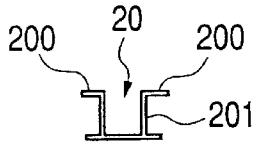
Figure 1E:
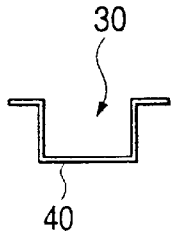
Figure 2A:
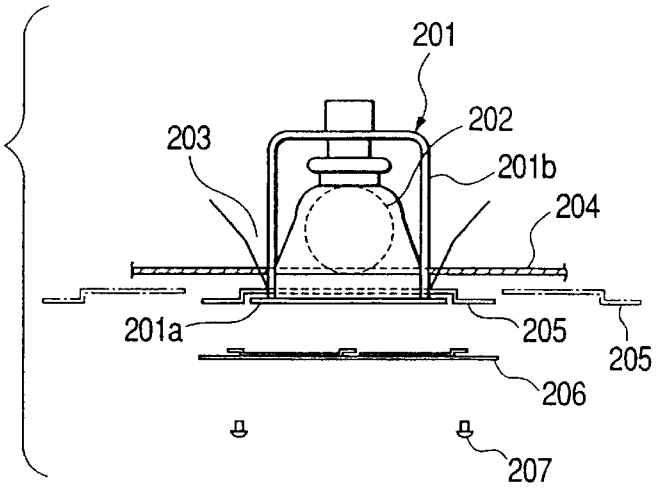
FIGS. 2(*a*) to 2(*e*) are drawings showing the first embodiment of the lamp protecting device according to the present invention, in which FIG. 2(*a*) is an exploded side cross-sectional view of a lighting fixture and a lamp protecting device, FIG. 2(*b*) is a side cross-sectional view of the lighting fixture to which the lamp protecting device is attached, FIG. 2(*c*) is a top view of a guard fixing attachment, FIG. 2(*d*) is a side cross-sectional view of the guard fixing attachment and FIG. 2(*e*) is a bottom view of the guard fixing attachment to which a guard is attached.
Figure 2B:
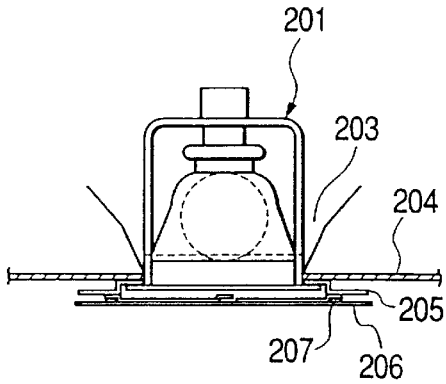
Figure 2C:
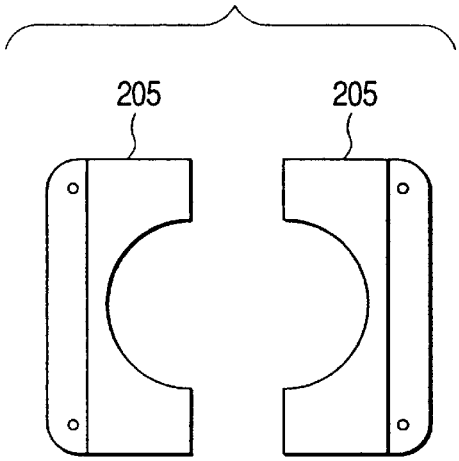
Figure 2E:
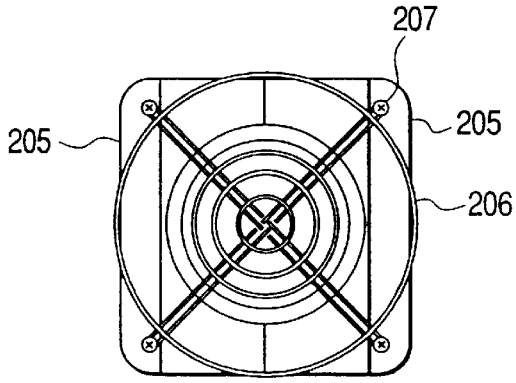
Figure 2D:
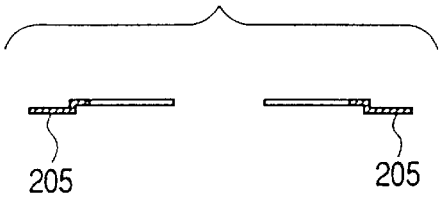

The preferred embodiments according to the present invention will be described referring to the attached drawings.

As shown in FIGS. 1(*a*) to 1(*c*), a lighting fixture mounting device of the first embodiment of the lighting fixture mounting device according to the present invention comprises a U shape channel 10 having extruding portions 100 extruding outwardly from both sides of a bottom plate of the U shape channel 10.

A lighting fixture 1 for a long cylindrical fluorescent lamp 3, for example, is fixed to the extruding portion 100 of the U shape channel 10 with screws 12. A wiring 2 of the lighting fixture 1 passes through a wiring hole 102 bored through the bottom plate of the U shape channel 10 and an inside of the U shape channel 10, and connected to an external electric source provided on a ceiling for example. Additionally, if the wiring 2 has a connector at its end for connecting to an inverter 4, for example, placed outside of the U shape channel 10, the wiring hole 102 should be large enough for the connector to pass through. By boring a plurality of wiring holes 102 longitudinally in the bottom plate of the U shape channel 10, the lighting fixture 1 can be placed easily in a different place along the U shape channel 10. These wiring holes 102 may be made in a semi-finished state and full opened as necessary at the place where the lighting fixture 1 is attached. In this way, the appearance can be kept from being spoiled by the wiring holes 102.

Then, side walls 101 of the U shape channel 10 are fixed to side surfaces of a pillar 13 with screws 12, with the pillar 13 in between. If self-tapping screws are used in place of the screws 12, the side walls 101 can be fixed to the side surfaces of the pillar 13 without boring tap holes in the surface of the pillar 13. Rivets may be used in place of the screws 12.

The inverter 4 in FIG. 1(*a*) or FIG. 1(*b*) is placed at a place apart from the lighting fixturel, however, it may be incorporated into the lighting fixture 1.

FIG. 1(*d*) is a sectional view showing a U shape channel 20 used in the second embodiment of the lighting fixture mounting device according to the present invention. In this embodiment, the lighting fixture 1 is fixed to a flat surface of a wall, a ceiling or the like. In this embodiment, flanges 200 protruding outwardly from both ends of side walls 201 of a U shape channel 20 are provided, and the flanges 200 are fixed with screws to the flat surface. Since the second embodiment is similar to the first embodiment, except that the flanges 200 are provided in the second embodiment, explanation with regard to those other than the flanges 200 is omitted. Additionally, the flanges 200 may be fixed to the flat surface with clamps or double coated adhesive tapes in place of the screws.

FIG. 1(*e*) is a sectional view showing a U shape channel 30 used in the third embodiment of the lighting fixture mounting device according to the present invention. In this embodiment, bottom plate 40 is made wider in width in place of providing the extruding portions 100 extruding outwardly from both sides of the bottom plate, and the lighting fixture 1 is fixed to the bottom plate. Since the third embodiment is similar to the first or second embodiment, except that the bottom plate 40 is made wider in width, explanation with regard to those other than the bottom plate 40 is omitted.

The lighting fixture mounting device according to the present invention is not limited for the lighting fixture for a long cylindrical fluorescent lamp, but it can also be applied for the lighting fixture for such as an incandescent lamp, a mercury lamp or the like.

As can be seen in FIGS. 2(*a*) and 2(*b*), a lighting fixture 201 in which a lamp 202 is placed and to which a lamp protecting device according to the present invention is attached is embedded in a built-in hole 203, formed in a ceiling 204, touching internally with an inner side surface of the built-in hole 203. A lower end of a case 201*b* of the lighting fixture 201 is exposed in the lower surface of the ceiling 204. At the lower end of the case 201*b*, a flange 201*a* is formed, and upper surface of the flange 201*a* is in touch with lower surface of the ceiling 204.

As shown in FIGS. 2(*c*) to 2(*e*), the first embodiment of the lamp protecting device according to the present invention comprises a guard fixing attachment 205 and a guard 206.

As shown in FIGS. 2(*c*) and 2(*d*), the guard fixing attachment 205 comprises two rectangular plates each having semicircular cutout of which diameter is approximately same to the outer diameter of the case 201*b*. Each end portion opposite to the cutout of the rectangular plates is folded to form a step corresponding to the thickness of the flange 201*a*.

As shown in FIG. 2(*e*), the guard 206 comprises a plurality of circular members made of metal wires, for example, and rod like or U shape members made of a metal wire, for example, for connecting the circular members. The guard 206 is constructed such that it can be attached to the guard fixing attachment 205 with screws 207. The size of the metal wire used should be such one that does not largely block the transmission of the light from the lamp 202. Slender plate members may be used in place of the rod like or the U shape members. The size of the guard 206 should be such one that covers at least the lower surface of the lighting fixture 201.

The guard fixing attachment 205 thus prepared is attached to the lighting fixture 201 as follows.

Firstly, the lighting fixture 201 is moved downward a little to make a gap that makes it possible for the guard fixing attachment 205 to be inserted between the lower surface of the ceiling 204 and the upper surface of the flange 201*a*. Since the gap is very thin, the wiring need not be disconnected from the lighting fixture 201.

Then, each of the two rectangular plates of the guard fixing attachment 205 is inserted from each other side of the lighting fixture 201 to the gap between the lower surface of the ceiling 204 and the upper surface of the flange 201*a* until inner surface of the semi-circle of the U shape cutout contacts with the outer surface of the case 201*b* of the lighting fixture 201.

Then, the lighting fixture 201 is raised up to fix the guard fixing attachment 205 in between the lower surface of the ceiling 204 and the upper surface of the flange 201*a*.

Then, the guard 206 is attached to the guard fixing attachment 205 with screws 207. The guard 206 may also be attached to the guard fixing attachment 205 with push-nuts, clamps or the like in place of the screws 207.

Figure 3A:
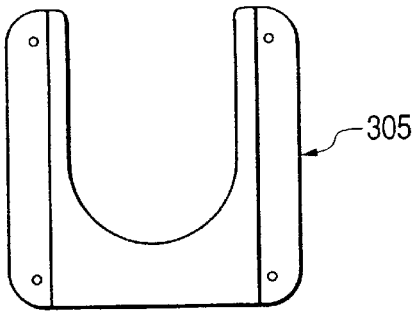
FIGS. 3(*a*) and 3(*b*) are a top view and side cross-sectional view, respectively, of another guard fixing attachment used in the second embodiment of the lamp protecting device according to the present invention.
Figure 3B:
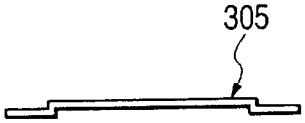

In the second embodiment of the lamp protecting device according to the present invention, as shown in FIGS. 3(*a*) and 3(*b*), a guard fixing attachment 305 made of a rectangular plate in place of the guard fixing attachment 205 comprising two rectangular plates in the first embodiment. The guard fixing attachment 305 has a U shape cutout, the width of which is approximately equal to the outer diameter of the case 201*b* of the lighting fixture 201, and the inner end of which forms a semi-circle with a diameter approximately equal to the outer diameter of the case 201*b* of the lighting fixture 201. The end portions parallel with the U shape cutout is folded to form steps corresponding to the thickness of the flange 201*a*.

The guard fixing attachment 305 thus prepared is attached to the lighting fixture 201 as follows.

Firstly, the lighting fixture 201 is moved downward a little to make a gap that makes it possible for the guard fixing attachment 305 to be inserted between the lower surface of the ceiling 204 and the upper surface of the flange 201*a*. Since the gap is very thin, the wiring need not be disconnected from the lighting fixture 201.

Then, the guard fixing attachment 305 is inserted from a side of the lighting fixture 201 to the gap between the lower surface of the ceiling 204 and the upper surface of the flange 201*a* until inner surface of the semi-circle of the U shape cutout contacts with the outer surface of the case 201*b* of the lighting fixture 201.

Then, the lighting fixture 201 is raised up to fix the guard fixing attachment 305 in between the lower surface of the ceiling 204 and the upper surface of the flange 201*a*.

Since the succeeding processes are similar to those of the first embodiment, the explanation is omitted.

Additionally, the shape of the cutout of the present embodiment may be any shapes as far as the cutout enable the guard fixing attachment 305 to be inserted between the flange 201*a* and the ceiling 204 with the case 204 passing through it. For example, the cutout may be a concave shape other than U shape. The guard 206 may be attached to the guard fixing attachment 305 prior to, or after of, the insertion of the guard fixing attachment 305 into the gap.

Figure 4A:
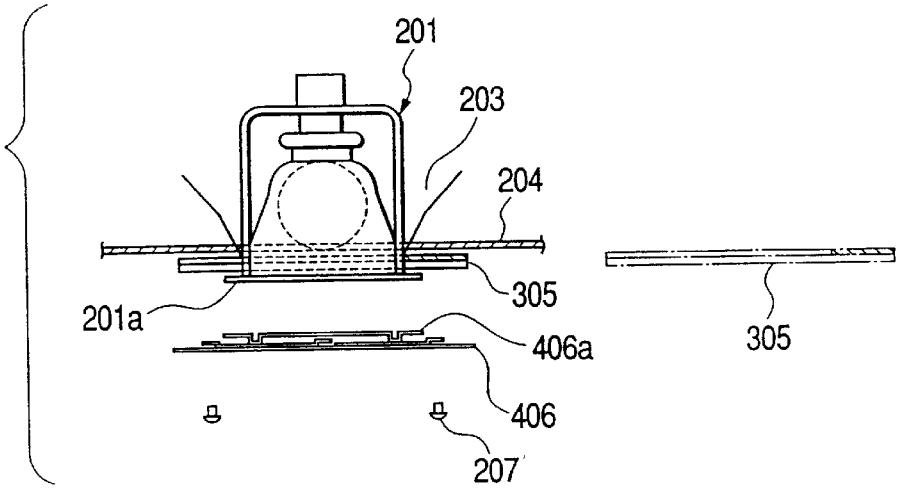
FIGS. 4(*a*) to 4(*c*) are drawings showing the third embodiment of the lamp protecting device according to the present invention, in which FIG. 4(*a*) is an exploded side cross-sectional view of a lighting fixture and a lamp protecting device, FIG. 4(*b*) is a side cross-sectional view of the lighting fixture to which the lamp protecting device is attached, FIG. 4(*c*) is a bottom view of a guard fixing attachment to which a guard is attached.
Figure 4B:
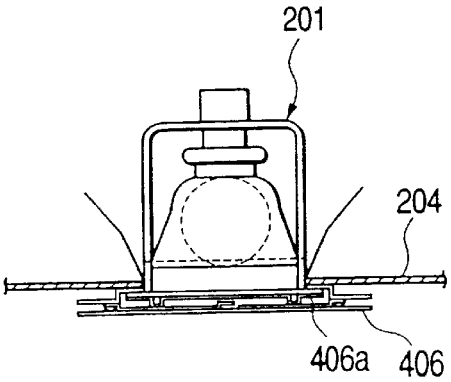
Figure 4C:
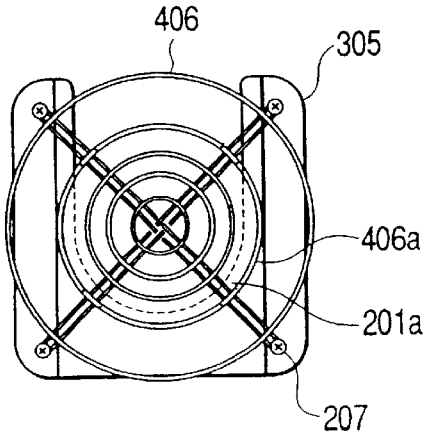

In the third embodiment of the lamp protecting device according to the present invention, a guard 406 as shown in FIGS. 4(*a*) to 4(*c*), is used in place of the guard 206 in the first or the second embodiment. The guard 406 is constructed such that a circular member 406*a* of the guard 406 contacts with the flange 201*a*. The circular member 406*a* limits the movement of the guard 406 relative to the flange 201*a*. Since the third embodiment is similar to the first or the second embodiment, except that the guard 406 is used in place of the guard 206, explanation with regard to those other than the guard 406 is omitted.

Figure 5A:
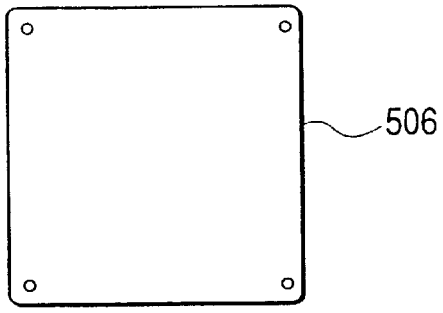
FIGS. 5(*a*) and 5(*b*) are drawings showing a guard used in the fourth embodiment of the lamp protecting device according to the present invention, in which FIG. 5(*a*) is a top view of the guard and FIG. 5(*b*) is a side view of the guard.
Figure 5B:
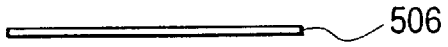

In the fourth embodiment of the lamp protecting device according to the present invention, a guard 506 made of a transparent acrylic resin as shown in FIGS. 5(*a*) and 5(*b*) is used in place of the guard 206 or the guard 406 in the first, the second or the third embodiment. The guard 506 may also be made of a glass or a trasparent resin other than acrylic resin. Since the fourth embodiment is similar to the first, the second or the third embodiment, except that the guard 506 is used in place of the guard 206 or the guard 406, explanation with regard to those other than the guard 506 is omitted.

Figure 6A:
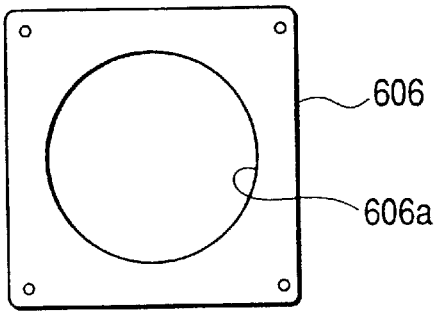
FIGS. 6(*a*) to 6(*c*) are drawings showing a guard used in the fifth embodiment of the lamp protecting device according to the present invention, in which FIG. 6(*a*) is a top view of the guard, FIG. 6(*b*) is a side cross-sectional view of the guard and FIG. 6(*c*) is a top view of the guard in which heat dissipation holes are bored.
Figure 6C:
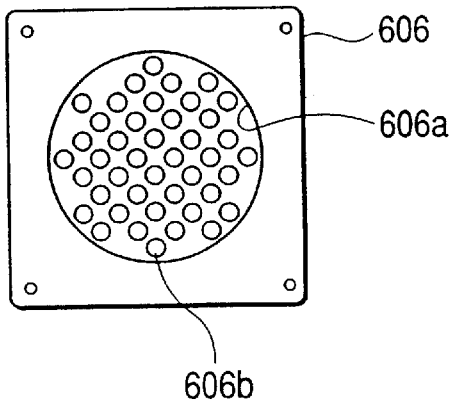
Figure 6B:
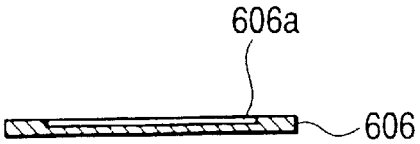

In the fifth embodiment of the lamp protecting device according to the present invention, a guard 606 having a circular hollow 606*a* with diameter approximately equal to the outer diameter of the flange 201*a*, formed on the upper face of a plate made of a transparent acrylic resin, as shown in FIGS. 6(*a*) and 6(*b*), is used in place of the guard 506 in the fourth embodiment. Side wall of the circular hollow 606*a* contacts with the outer surface of the flange 201*a* to limit the movement of the guard 606 relative to the flange 201*a*. If necessary, heat dissipation holes 606*b* as shown in FIG. 6(*c*) may be bored. Since the fifth embodiment is similar to the first, the second, the third or the fourth embodiment, except that the guard 606 is used in place of the guard 206, the guard 406 or the guard 506, explanation with regard to those other than the guard 606 is omitted.

What is claimed is:

1. A lamp protecting device for a lighting fixture embedded in a built-in hole formed in a ceiling and having a flange formed on a lower end of a case of said lighting fixture and exposed out of said ceiling, comprising a guard fixing attachment made of a rectangular plate having a cutout through which said case can be passed through and outer ends folded to form steps corresponding to the thickness of said flange, and a guard made of a plurality of circular members and rod like members connecting said circular members, wherein said lighting fixture is moved downward to make a gap between lower surface of said ceiling and upper surface of said flange, then said guard fixing attachment is inserted into said gap, then said lighting fixture is moved upward to fix said guard fixing attachment is inserted into said gap, then said lighting fixture is moved upward to fix said guard fixing attachment in between said lower surface of said ceiling and said upper surface of said flange, and then said guard is attached to said guard fixing attachment.

2. The lamp protecting device according to claim 1, wherein said guard fixing attachment comprises two rectangular plates each having semicircular cutout of which diameter is approximately same to the outer diameter of said case and said step is formed at each end portion opposite to said cutout, each of said two rectangular plates is inserted into said gap from each other side of said lighting fixture until inner surface of said semi-circle of said cutout contacts with the outer surface of said case.

3. The lamp protecting device according to claim 1, wherein said guard fixing attachment is made of a rectangular plate having a U shape cutout of which width is approximately equal to the outer diameter of said case and the inner end of which forms a semi-circle with a diameter approximately equal to the outer diameter of said case, said steps are formed at end portions parallel to said U shape cutout, and said guard fixing attachment is inserted to said gap until inner surface of said semi-circle contacts with the outer surface of said case.

4. The lamp protecting device according to claim 1, wherein one of said circular members of said guard is formed to contact with said flange.

5. The lamp protecting device according to claim 2, wherein one of said circular members of said guard is formed to contact with said flange.

6. The lamp protecting device according to claim 3, wherein one of said circular members of said guard is formed to contact with said flange.

7. The lamp protecting device according to claim 1, wherein said guard is formed of a transparent plate.

8. The lamp protecting device according to claim 2, wherein said guard is formed of a transparent plate.

9. The lamp protecting device according to claim 3, wherein said guard is formed of a transparent plate.

10. The lamp protecting device according to claim 7, wherein a circular hollow with a diameter approximately equal to said outer diameter of said flange and having a side wall that contacts with the outer surface of said flange is formed.

11. The lamp protecting device according to claim 8, wherein a circular hollow with a diameter approximately equal to said outer diameter of said flange and having a side wall that contacts with the outer surface of said flange is formed.

12. The lamp protecting device according to claim 9, wherein a circular hollow with a diameter approximately equal to said outer diameter of said flange and having a side wall that contacts with the outer surface of said flange is formed.

* * * * *